US009290721B2

(12) United States Patent
Hood et al.

(10) Patent No.: US 9,290,721 B2
(45) Date of Patent: Mar. 22, 2016

(54) VISUALLY PERCEIVABLE IMAGE-FORMING DYE SCAVENGING ARTICLE

(75) Inventors: David K. Hood, Basking Ridge, NJ (US); Surya Kamin, Skillman, NJ (US)

(73) Assignee: ISP INVESTMENTS INC., Wilmington, DE (US)

( * ) Notice: Subject to any disclaimer, the term of this patent is extended or adjusted under 35 U.S.C. 154(b) by 97 days.

(21) Appl. No.: 13/991,776

(22) PCT Filed: Dec. 9, 2011

(86) PCT No.: PCT/US2011/064085

§ 371 (c)(1), (2), (4) Date: Aug. 5, 2013

(87) PCT Pub. No.: WO2012/078950

PCT Pub. Date: Jun. 14, 2012

(65) Prior Publication Data

US 2013/0303431 A1 Nov. 14, 2013

Related U.S. Application Data

(60) Provisional application No. 61/421,422, filed on Dec. 9, 2010.

(51) Int. Cl.

| | |
|---|---|
| ***C11D 17/00*** | (2006.01) |
| ***C11D 3/37*** | (2006.01) |
| ***C11D 3/00*** | (2006.01) |
| ***C11D 17/04*** | (2006.01) |
| ***D06P 5/00*** | (2006.01) |

(52) U.S. Cl.

CPC ..... *C11D 3/0021* (2013.01); *C11D 3/37* (2013.01); *C11D 3/3761* (2013.01); *C11D 3/3776* (2013.01); *C11D 17/046* (2013.01); *C11D 17/049* (2013.01); *D06P 5/002* (2013.01)

(58) Field of Classification Search

CPC ..... C11D 17/041; C11D 17/00; C11D 3/37; C11D 3/3757; C11D 3/3769; C11D 3/3917; C11D 3/392

See application file for complete search history.

(56) References Cited

U.S. PATENT DOCUMENTS

| | | | |
|---|---|---|---|
| 2003/0118730 | A1 | 6/2003 | Aouad et al. |
| 2004/0086749 | A1 | 5/2004 | Kennedy et al. |
| 2009/0137170 | A1 | 5/2009 | Luoni et al. |
| 2009/0151083 | A1 | 6/2009 | Orlandi et al. |

FOREIGN PATENT DOCUMENTS

| | | | |
|---|---|---|---|
| WO | WO 99/15614 | A1 | 4/1999 |

OTHER PUBLICATIONS

International Search Report, PCT/US2011/064085, published on Jun. 14, 2012.

*Primary Examiner* — Charles Boyer

(74) *Attorney, Agent, or Firm* — William J. Davis

(57) ABSTRACT

The present application relates to a visually perceivable image-forming dye scavenging article capable of absorbing and/or inhibiting transfer of fugitive dyes released during laundering, the article comprising (i) a support substrate with an imprint of an image on at least one surface of the substrate; (ii) at least one dye scavenging compound fixably adhered to the imprinted image; (iii) optionally, a film forming agent; (iv) optionally, a cross-linking agent; (v) optionally, a rheology modifying agent; and (vi) optionally, a catalyst to accelerate the polymerization reaction. Also disclosed is a method of manufacturing the article and use of the same.

9 Claims, No Drawings

VISUALLY PERCEIVABLE IMAGE-FORMING DYE SCAVENGING ARTICLE

FIELD

The present application relates to a dye scavenging article, and more particularly, to a visually perceivable image-forming dye scavenging article capable of absorbing and/or inhibiting transfer of fugitive dyes released during laundering.

BACKGROUND

When articles or garments are laundered, a major problem associated during the course of laundering operations involves the possibility of colored items to discharge dye into the wash solution. The discharged extraneous dye, which may also be referred as "fugitive dye," is then deposited or associated onto other articles or garments present in the wash cycle and thereby alters the color of garments. This dye carry-over phenomenon is referred to as "dye transfer". The discoloration of articles or garments results in unsatisfactory and faded appearance and after many times are rendered inappropriate for further use. Another similar problem involves the premature fading of articles or garments within the wash solution as a result of undesirable dye discharge. One way of addressing the problem of extraneous dye deposition onto articles or garments within the wash solution is to form a complexation and/or absorption of fugitive extraneous dyes before they can be deposited onto articles or garments.

U.S. Pat. Nos. 5,451,337 and 5,474,576 disclose an approach to bleach the dyes that are released into the washing solution before they have a chance to transfer to other articles and/or garments. The use of bleaching agents has the undesirable effect of bleaching not only the fugitive dyes, but also bleaching the dyes still attached to the articles and/or garments, resulting in fading or color change of the dyed articles and/or garments. The oxidizing agents can also interfere with laundry detergent components, making the detergents less effective.

U.S. Pat. No. 4,380,453 discloses other techniques for dealing with extraneous dyes in wash liquors involving the use of specific quaternized dye scavengers that are supported on cellulosic substrates. U.S. Pat. No. 4,494,264 discloses a "filtering envelope approach" to address this problem and wherein the dye-generating articles or garments are physically separated from non dye-generating garments.

U.S. Pat. No. 5,698,476 discloses a system for removing extraneous, random free-flowing dyes from laundry washing applications which comprises a novel unitary dosing laundry article that can freely circulate among items being laundered. The laundry article further comprises a dye absorber and a dye transfer inhibitor which are introduced into wash liquor via a support matrix. The dye absorber maintains a relational association with the support matrix in the wash liquor, whereas the dye transfer inhibitor is delivered up from the support matrix to the wash liquor and may be evenly distributed throughout the wash liquor.

U.S. Pat. No. 4,954,292 assigned to Hull et al. discloses the use of polyvinyl pyrrolidone to prevent redeposition of soils or dyestuffs when used in a laundry detergent in combination with an anionic surfactant and a specific nonionic with an HLB of 10.5 or less.

Several approaches to address the problem of fugitive extraneous dyes in a laundering cycle involve the use of dye transfer inhibitors added directly to a wash liquor of the washing machine either as a laundry aid or as a supplementary component of the laundry detergent itself. Numerous substances have been studied as dye transfer inhibitors. A number of these substances include polyvinyl pyrrolidone (U.S. Pat. No. 4,006,092), polyvinyl alcohol (CA 2,104,728), polyvinyl imidazole (DE 3,840,056), polyamine-N-oxides (EP 579,295), cationic starches (U.S. Pat. No. 4,756,849; EP 044003), minerals such as magnesium aluminate and hydrotalcite (U.S. Pat. No. 4,392,961; U.S. Pat. No. 4,661,282; U.S. Pat. No. 4,929,381; and U.S. Pat. No. 5,149,456), polyethylene imines (DE 3,124,210), polyvinyl oxazolidone (DE 2,814,329), enzymatic systems including peroxidases and oxidases (U.S. Pat. No. 5,273,896; U.S. Pat. No. 5,288,765), oxidants (U.S. Pat. No. 4,005,029; U.S. Pat. No. 4,123,376; U.S. Pat. No. 4,300,897; and U.S. Pat. No. 4,338,210), cationic and amphoteric surfactants (U.S. Pat. No. 4,239,659; and U.S. Pat. No. 4,261,869), as well as propylene oxide reaction products (U.S. Pat. No. 4,389,214).

One aspect of the present application relates to a dye scavenging article for the convenient control of fugitive extraneous dyes which may be present in the wash liquor, wherein the article adsorbs such dyes onto a support substrate in a novel way.

The present application also provides a visually perceivable image-forming dye scavenging article capable of absorbing and/or inhibiting transfer of extraneous fugitive dyes released during laundering.

SUMMARY

The present application relates to a visually perceivable image-forming dye scavenging article capable of absorbing and/or inhibiting transfer of fugitive dyes released during laundering. In accordance with one aspect the article comprises (i) a support substrate comprising a desired imprint of an image on at least one surface of the substrate; (ii) at least one dye scavenging compound fixably adhered to the imprinted image; (iii) optionally, at least one film forming agent fixably adhered to the imprinted image; (iv) optionally, at least one cross-linking agent fixably adhered to the imprinted image; (v) optionally, at least one rheology modifying agent fixably adhered to the imprinted image; and (vi) optionally, at least one catalyst employed to accelerate the reaction.

In accordance with certain aspects, the support substrate is made of natural fabric, synthetic fabric, natural non-woven fabric and/or synthetic non-woven fabric in the form of continuous ring or rectangular fabric sheet.

According to another aspect of the present application, the imprinted image is meant for communicating a visually perceivable message or information to the users in the form of pictures, shapes, symbols, trademarks, alphabets of any language and/or numerical letters of any language. The visually perceivable message or information can be generated after adsorption of fugitive extraneous dyes from the laundering process.

In one aspect of the present application, a method of manufacturing dye-scavenging article comprises the steps of (a) providing an support substrate comprising a desired imprint of an image on at least one surface or side of the substrate; (b) applying coating of an aqueous coating composition comprising (i) a dye scavenging agent; (ii) optionally, a film forming agent, optionally, a cross-linking agent, optionally, a rheology modifying agent and/or optionally, a catalyst; and (c) polymerizing the coating resulting from (b) by any appropriate method which is known to a person skilled in the art, preferably through a thermal method and/or an irradiation method.

In yet another aspect of the present application, a method is provided of absorbing and/or inhibiting transfer of fugitive dyes released during laundering, the method comprising introducing a dye scavenging article to a wash liquor of a laundering machine and wherein, the article may comprise: (i) a support substrate comprising a desired imprint of an image on at least one surface of the substrate; (ii) at least one dye scavenging compound fixably adhered to the imprinted image; (iii) optionally, at least one film forming agent fixably adhered to the imprinted image; (iv) optionally, at least one cross-linking agent fixably adhered to the imprinted image; (v) optionally, at least one rheology modifying agent fixably adhered to the imprinted image; and (vi) optionally, at least one catalyst employed to accelerate the reaction.

DETAILED DESCRIPTION

While this specification concludes with claims particularly pointing out and distinctly claiming that, which is regarded as the invention it is anticipated that the invention can be more readily understood through reading the following detailed description of the invention and study of the included examples.

By the term "comprising" herein is meant that various optional, compatible components can be used in the compositions herein, provided that the important ingredients are present in the suitable form and concentrations. The term "comprising" thus encompasses and includes the more restrictive terms "consisting of" and "consisting essentially of" which can be used to characterize the essential ingredients of the disclosed composition.

All percentages, parts, proportions and ratios as used herein, are by weight of the total composition, unless otherwise specified. All such weights as they pertain to listed ingredients are based on the active level and, therefore, do not include solvents or by-products that may be included in commercially available materials, unless otherwise specified.

All references to singular characteristics or limitations of the present invention shall include the corresponding plural characteristic or limitation, and vice-versa, unless otherwise specified or clearly implied to the contrary by the context in which the reference is made.

Numerical ranges as used herein are intended to include every number and subset of numbers contained within that range, whether specifically disclosed or not. Further, these numerical ranges should be construed as providing support for a claim directed to any number or subset of numbers in that range.

As used herein, the words "preferred," "preferably" and variants thereof refer to embodiments of the invention that afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

References herein to "one embodiment," or "one aspect" or "one version" or "one objective" of the invention may include one or more of such embodiment, aspect, version or objective, unless the context clearly dictates otherwise.

All publications, articles, papers, patents, patent publications, and other references cited herein are hereby incorporated herein by reference for all purposes to the extent consistent with the disclosure herein.

The term "polymer" refers to a compound comprising repeating structural units (monomers) connected by covalent chemical bonds. The definition includes oligomers. Polymers may be further derivatized (example by hydrolysis), crosslinked, grafted or end-capped. Non-limiting examples of polymers include copolymers, terpolymers, quaternary polymers, and homologues. A polymer may be a random, block, or an alternating polymer, or a polymer with a mixed random, block, and/or alternating structure. Polymers may further be associated with solvent adducts.

The term "homopolymer" refers to a polymer consisting essentially of a single type of repeating structural unit (monomer). The definition includes homopolymers with solvent adducts.

The term "copolymer" refers to a polymer consisting essentially of two types of repeating structural units (monomers). The definition includes copolymers having solvent adducts.

The term "free radical addition polymerization initiator" refers to a compound used in a catalytic amount to initiate a free radical addition polymerization. The choice of an initiator depends mainly on its solubility and decomposition temperature.

"Polymerize" and "cure" are interchangeable and mean to polymerize the coating composition. The polymerization or curation may alter the physical state of the composition, to make it transform from a fluid to a less fluid state, to go from a tacky or non-tacky state, to go from a soluble to insoluble state, or to decrease the amount of polymerizable monomer by its consumption in a reaction.

The term "crosslinked" herein refers to a composition containing intramolecular and/or intermolecular crosslinks, whether arising through covalent or non-covalent bonding. "Noncovalent" bonding includes both hydrogen bonding and electrostatic (ionic) bonding.

The term "acrylates" includes both acrylates (e.g., derived from acrylic acid) and methacrylates (e.g., derived from methacrylic acid). Analogously, the term "acrylamides" includes acrylamides, methacrylamides and polyacrylamides.

The expression "rheology modifying" as used herein with reference to a polymer deals with the property of the polymer to change the rheological properties of a given composition. The rheological properties that may be changed include, but are not limited to, solution viscosity, gelation, viscosity changes under shear stress, and gel pick-up in the presence of the polymer.

The present application describes a visually perceivable image-forming dye scavenging article capable of absorbing and/or inhibiting transfer of fugitive dyes released during laundering. In one aspect, the article comprises (i) a support substrate comprising a desired imprint of an image on at least one surface of the substrate; (ii) at least one dye scavenging compound fixably adhered to the imprinted image; (iii) optionally, at least one film forming agent fixably adhered to the imprinted image; (iv) optionally, at least one cross-linking agent fixably adhered to the imprinted image; (v) optionally, at least one rheology modifying agent fixably adhered to the imprinted image; and (vi) optionally, at least one catalyst employed to accelerate the reaction.

According to one embodiment of this application, the support substrate is made of natural fabric, synthetic fabric, natural non-woven fabric and/or synthetic non-woven fabric in the form of continuous ring or rectangular fabric sheet. The fabric may be spunlaced, spunbonded, thermobonded and/or airlaided. Non-limiting examples of these materials include cellulosic materials such as wood pulp, rayon, and cotton, in both woven and non-woven forms; and synthetic polymeric materials such as polyester, polyethylene, polypropylene, and polyurethane. The support substrate comprises one or more layers made of combinations of materials with the preferred properties. The support substrate is water permeable to let the wash solution pass through to increase absorption of fugitive dyes by the dye scavenging polymeric agent.

Accordingly, in accordance with one aspect of the present application, the imprinted image is provided for communicating a message to its users or consumers. The imprinted image of the present application includes but is not limited to a picture, a shape, a symbol, a logo, a trademark, alphabets of any language and/or numerical letters of any language.

The imprinted image on a support substrate of a dye scavenging article may be obtained by techniques that are known in the art. Non-limiting techniques for creating an imprinted image include gravure printing, flexographic printing, spraying, inkjet printing, forward or reverse roll coating, direct forward gravure coating, screen printing, hand block printing, perrotine printing, engraved copper plate printing, roller printing, cylinder printing, machine printing, stencil printing or digital textile printing.

In accordance with one aspect of the present application, a dye scavenging compound may be selected from the following non-limiting group of compounds: polyvinyl pyrrolidone, polyvinyl polypyrrolidone, crosslinked polyvinyl pyrrolidone, hydrophobically, anionically or cationically modified polyvinyl pyrrolidone, polyvinyl alcohol, polyvinyl imidazole, copolymers of vinylpyrrolidone and vinyl imidazole, polyamine-N-oxides such as polyvinylpyridine-N-oxide, cationic starches, magnesium aluminate, hydrotalcite, proteins, hydrolyzed proteins, polyethylene imines, polyvinyl oxazolidone, enzymes, oxidants, cationic surfactants, amphoteric surfactants, propylene oxide reaction products, polyamino acids, block co-polymers of alkylene oxides, polyamines, polyamides, methyl cellulose, carboxyalkyl celluloses, guar gum, natural gums, alginic acid, polycarboxylic acids, cyclodextrins, amine oxides, betaines, sultaines, polyquaternium compounds, mono-functional monomers, di-functional monomers, tri-functional monomers, diallyldimethyl ammonium chloride (DADMAC), diallyldimethyl ammonium bromide, diallyldimethyl ammonium sulfates, diallyldimethyl ammonium phosphates, dimethallyl dimethyl ammonium chloride, diethylallyl dimethyl ammonium chloride, diallyl-di(beta-hydroxyethyl) ammonium chloride, diallyl-di(beta-ethoxyethyl) ammonium chloride, a cyano- or guanidino-containing compound such as cyanamides or salts thereof, dicyanamides or salts thereof, dicyandiamides or salts thereof, guanidines or salts thereof, biguanidines or salts thereof. Further, more than one of the above dye scavenging compound may be employed in the present application.

Examples of suitable mono-functional monomers include 2-phenoxy ethyl acrylate (PHEA), 2-(2-ethoxyethoxy)ethyl acrylate (EOEOEA), lauryl acrylate (LA), Stearyl acrylate (SA), isobornyl acrylate (IBOA), acrylic acid-2-ethylhexyl ester, acryloyl morpholine (ACMO), cyclic trimethylol-propane formal acrylate (CTFA), C8-C10 acrylate (ODA), isodecyl acrylate (ISODA), lauryl methacrylate (LM), and stearyl methacrylate (SM).

Examples of suitable di-functional monomers include 1,6-hexanediol diacrylate (HDDA), dipropylene glycol diacrylate (DPGDA), tripropylene glycol diacrylate (TPGDA), 1,4-butanediol diacrylate (BDDA), 1,9-nonanediol diacrylate (NNDA), neopentyl glycol diacrylate (NPGDA), propoxylated neopentyl glycol diacrylate (NPG2PODA), polyethylene glycol (200) diacrylate (PEG(200)DA), polyethylene glycol (400) diacrylate (PEG(400)DA), polyethylene glycol (600) diacrylate (PEG(600)DA), ethoxylated bisphenol-A diacrylate (BPA2EODA), triethylene glycol diacrylate (TEGDA), triethylene glycol dimethacrylate (TEGDMA), diethylene glycol dimethacrylate (DEGDMA), and ethoxylated bisphenol-A dimethacrylate (BPA10EODMA).

Examples of suitable tri-functional monomers include trimethylolpropane triacrylate (TMPTA), pentaerythritol triacrylate (PET3A), ethoxylated tri-methylolpropane triacrylate (TMP3EOTA), propxylated tri-methylolpropane triacrylate (TMP3POTA), propoxylated glyceryl triacrylate (GPTA), trimethylolpropane trimethylacrylate (TMPTMA), and ethoxylated trimethylolpropane trimethacrylate (TMP3EOTMA). Examples of multifunctional monomers include pentaerythritol tetraacrylate (PETA) and dipentaerythritol hexaacrylate (DPHA).

Accordingly, it is an embodiment of the present application to employ a polymer comprising N-vinyl amide monomer and a dual functional monomer as a dye scavenging compound. The dual functional monomer may comprise glycidyl acrylate and a third polymerizable monomer. The term "dual functional monomer" refers to monomers having the structure

Q-R-E where Q is an oxirane, oxetane, aziridine, oxazoline, or benzoxazine; E is a polymerizable functionality containing a carbon-carbon double bond; and R is an aliphatic and/or aromatic moiety with or without a heteroatom. It is possible to incorporate the monomer into a polymer yielding a free carbon-carbon double bond and/or a free, ionically polymerizable functionality.

The term "N-vinyl amide monomer" refers to monomers including, but not limited to, N-vinyl pyrrolidone, N-vinyl valerolactam, N-vinyl caprolactam, and N-vinyl formamide. N-Vinyl pyrrolidone, N-vinyl formamide, and N-vinyl caprolactam are preferred.

The term "glycidyl acrylates" refers to alkyl acrylate monomers having a glycidyl group attached to an alkyl acrylate monomer. Further, the alkyl group can be, but is not limited to, alkyl groups containing $C_1$-$C_{12}$ carbon atoms. Non limiting examples of suitable alkyl acrylate monomers are the glycidyl (alkyl) acrylates such as, GMA, glycidyl ethacrylate, glycidyl butylacrylate, and glycidyl dodecyl acrylate. Preferred glycidyl (alkyl) acrylates useful in the practice of the present invention include GMA, glycidylethacrylate, glycidylbutylacrylate and glycidyldodecylacrylate. GMA is a particularly useful monomer.

The term "third polymerizable monomer" refers to additional monomers present in the composition including, but not limited to, HEMA, vinyl acetate (VA), ethyl acrylate, methyl acrylate, methylmethacrylate, dimethylaminoethyl methacrylate (DMAEMA), dimethylaminopropyl methacrylate (DMAPMA) acrylamide, methacrylamide, acrylonitrile, ethylene, styrene, maleic anhydride (MAN), acrylic acid (AA), sodium vinylsulfonate, vinyl chloride, vinylpyridine, trimethylvinylsilane, vinyl propionate, crotonic acid, polyfunctional acrylate, polyfunctional allyl ether, vinyl imidazole, N-vinyl imidazole, vinyl carbonate and allyl acetate and allyl alcohol. Preferred third monomers useful in the practice of certain aspects of the present invention include HEMA, VA, crotonic acid, acrylamide, and MAN. HEMA, MAN, and VA are particularly useful. The third polymerizable monomer can be selected to yield a polymer varied in charge, resulting in an anionic, non-ionic, cationic, or zwitterionic polymeric material.

Specific dual functional monomers useful in accordance with the present invention include, without limitation, allyl glycidyl ether ([(2-propenyloxy) methyl]-oxirane), butadiene monoxide, 2-(1-aziridinyl)-ethyl methacrylate, vinyl cyclohexene monoxide, 2-Isopropenyl-2-oxazoline, 1,3-diallyl-5-glycidylisocyanurate, glycidyl-N-(3-isopropenyl-dimethylbenzyl)-carbamate, 3-N-(6-propyl vinyl ether) benzoxazine, and 2-(3-methyl-3-oxetanemethoxy) ethyl vinyl ether. More than one dual functional monomer may be used.

The preferred dye scavenging agent or compound of the present application is crosslinked polyvinyl pyrrolidone and/or polyvinyl poly pyrrolidone.

The molecular weight (MW) of the desired dye scavenging compound of the present application typically is in the range of about 500 to about 2,000,000.

Optionally, any water-soluble or water-dispersible film-forming agent or polymer, or mixtures of polymers, may be used in the present application. The preferred film-forming agent may be selected from the group consisting of anionic polymer latex, cationic polymer latex, amphoteric polymer latex, pullulan, methylcellulose, ethylcellulose, propylcellulose, hydroxypropylmethyl cellulose, hydroxyethyl cellulose, hydroxypropyl cellulose, ethers and esters of alkyl celluloses, carboxymethyl cellulose, ethylhydroxyethylcellulose, ethyl-methylcellulose, hydroxyethyl methylcellulose, polyvinyl-caprolactam, polyvinyl-pyrrolidone, polyvinyl-pyrrolidone/vinylacetate copolymer, polyacrylic acids, polyacrylic acid salts, acrylic polymers, polyacrylates, polyacrylamides, acrylic maleic anhydride copolymers, methyl-methacrylate copolymers, carboxyvinyl-polymers, polyethylene oxides, polyvinyl methyl ether-maleic anhydrides, polymaleic anhydrides, styrene maleic anhydride, polyethylene glycols, acrylamide copolymers, ethylene-maleic anhydride resin series, polyethyleneimines, polyvinyl alcohols (PVA), partially hydrolyzed polyvinyl acetate, alginates, sodium alginate, pectin, tragacanth gum, guar gum, acacia gum, arabic gum, gelatin, amylase, high amylase starch, hydroxy-propylated high amylase starch, dextrin, chitin, chitosan, levan, elsinan, collagen, zein, gluten, soy protein isolate, whey protein isolate, and casein, alone or in combination.

Polyvinyl alcohols (PVA) are particularly useful film-forming agents. Film-forming agents comprising polyvinyl alcohol can be prepared that are particularly rapidly dissolvable at colder temperatures. Further, polyvinyl alcohols having varying average molecular weights (i.e. mean weights of the molar masses) such as from about 5,000 to about 5,000,000 may be used. Likewise, polyvinyl alcohol having varying degrees of hydrolysis may also be used to advantage.

The anionic polymer latex, a film-forming agent is prepared by polymerization product of (i) at least one ethylenically unsaturated first monomer; and (ii), at least one ethylenically unsaturated second monomer that is anionic or a precursor to an anion. The cationic polymer latex, a film-forming agent can be prepared as the polymerization product of (i) at least one ethylenically unsaturated first monomer; and (ii), at least one ethylenically unsaturated second monomer that is cationic or a precursor to a cation.

The polymer latex, a film-forming agent, may be selected from the group consisting of styrene-butadiene copolymer, vinyl acetate-ethylene copolymer, acrylate copolymer, acrylate terpolymer, styrene-acrylate copolymer, modified styrene-butadiene copolymer, carboxyl/hydroxyl group modified styrene-butadiene copolymer, ethylene-acrylate copolymer, natural rubber latex, methyl methacrylate-butadiene copolymer, acrylonitrile-butadiene copolymer, isoprene-isobutylene copolymer, styrene-butadiene-vinylpyridine copolymer, ethylene-propylene copolymer, ethylene-propylene-diene copolymer, chloroprene polymer, butadiene polymer, isoprene polymer, poly(styrene-alkyl acrylate) copolymer, poly(styrene-1,3-diene) copolymer, poly(styrene-alkyl methacrylate) copolymer, poly(styrene-alkyl acrylate-acrylic acid) copolymer, poly(styrene-1,3-diene-acrylic acid) copolymer, poly(styrene-alkyl methacrylate-acrylic acid) copolymer, poly(alkyl methacrylate-alkyl acrylate) copolymer, poly(alkyl methacrylate-aryl acrylate) copolymer, poly(aryl methacrylate-alkyl acrylate) copolymer, poly(alkyl methacrylate-acrylic acid) copolymer, poly(styrene-alkyl acrylate-acrylonitrile-acrylic acid) copolymer, poly(styrene-1,3-diene-acrylonitrile-acrylic acid) copolymer, poly(alkyl acrylate-acrylonitrile-acrylic acid) copolymer, poly(styrene-butadiene) copolymer, poly(methylstyrene-butadiene) copolymer, poly(methyl methacrylate-butadiene) copolymer, poly(ethyl methacrylate-butadiene) copolymer, poly(propyl methacrylate-butadiene) copolymer, poly(butyl methacrylate-butadiene) copolymer, poly(methyl acrylate-butadiene) copolymer, poly(ethyl acrylate-butadiene) copolymer, poly(propyl acrylate-butadiene) copolymer, poly(butyl acrylate-butadiene) copolymer, poly(styrene-isoprene) copolymer, poly(methylstyrene-isoprene) copolymer, poly(methyl methacrylate-isoprene) copolymer, poly(ethyl methacrylate-isoprene) copolymer, poly(propyl methacrylate-isoprene) copolymer, poly(butyl methacrylate-isoprene) copolymer, poly(methyl acrylate-isoprene) copolymer, poly(ethyl acrylate-isoprene) copolymer, poly(propyl acrylate-isoprene) copolymer, poly(butyl acrylate-isoprene) copolymer, poly(styrene-propyl acrylate) copolymer, poly(styrene-butyl acrylate) copolymer, poly(styrene-butadiene-acrylic acid) copolymer, poly(styrene-butadiene-methacrylic acid) copolymer, poly(styrene-butadiene-acrylonitrile-acrylic acid) copolymer, poly(styrene-butyl acrylate-acrylic acid) copolymer, poly(styrene-butyl acrylate-methacrylic acid) copolymer, poly(styrene-butyl acrylate-acrylononitrile) copolymer, poly(styrene-butyl acrylate-acrylononitrile-acrylic acid) copolymer, vinyl acetate-ethylene copolymer, vinyl acetate-ethylene-acrylic acid copolymer, vinyl acetate-acrylic acid copolymer, vinyl acetate-maleic anhydride copolymer, vinyl acetate-maleic acid ester copolymer, vinyl acetate-vinyl chloride copolymer, vinyl acetate-vinyl chloride-acrylic acid copolymer, vinyl chloride polymer, vinylidene chloride polymer, vinyl chloride-vinylidene chloride copolymer, urethane polymer, polyamide polymer, polyester polymer. The preferred polymer latex of the present application is styrene/butadiene copolymers, carboxyl modified styrene/butadiene copolymers, hydroxyl modified styrene/butadiene copolymers, polyurethanes, and/or vinyl acetate/ethylene copolymers.

In accordance with certain embodiments, a cross-linking agent may be used to facilitate the polymerization or curing of a coating composition comprising a dye scavenging article applied onto an imprinted image of the support substrate for the absorption and/or inhibition of transfer of fugitive dyes released during laundering. Examples of particularly useful cross-linking agents of the present application include, but are not limiting to, melamines, formaldehyde, chromates, polyfunctional silanes, zirconates, borates, polyfunctional acids and poly functional amines, alkylamino derivatives of methacrylic acid and methacrylamide, acid anhydrides, unsaturated aliphatic acids, vinyl derivatives, silanes, oxirane based glycidyl ethers, glycidyl acrylates, epoxides, epoxy compounds, acrylic anhydrides, oxazoline compounds, benzoxazine compounds, aziridine compounds, aziridine derivatives of methacrylates, isocyano derivatives of methacrylate, carbamic acid derivatives, sulfonate ester compounds, sulfonyl compounds, carbodiimide compounds, and various allyl compounds. Particularly preferred cross-linking agents of the present application include epoxy compounds, isocyanate compounds, carbodiimide compounds, glycidyl acrylates, and oxazoline compounds. Further, the crosslinking agents may be used alone or two or more kinds of them may be used in combination.

More particularly, the cross-linking agent may be selected from the group consisting of dimethylaminoethyl methacrylate, dimethylaminopropylmethacrylamide, maleic anhydride, maleic acid, acrylic acid, methacrylic acid, vinyl imidazole, 4-vinyl aniline, trimethylvinylsilane, crotonic acid, vinyl sulfone, allyl glycidyl ether ([(2-propenyloxy) methyl]-oxirane), butadiene monoxide, 2-(1-aziridinyl)ethyl methacrylate, vinyl cyclohexene monoxide, 4-vinyl-1-cyclohexene-1,2-epoxide, 2-Isopropenyl-2-oxazoline, 2-isocyanatoethyl methacrylate, 1,3-diallyl-5-glycidylisocyanurate, tert-butylaminoethyl methacrylate, glycidyl N-(3-isopropenyl dimethylbenzyl)carbamate, 3-N-(6-propyl vinyl ether) benzoxazine, epichlorohydrin, 2-(3-methyl-3-oxetanemethoxy) ethyl vinyl ether, allyl alcohol, allyloxy ethanol, allyloxy methanol, allyl urea, allyl amide, glycidyl acrylates for example, glycidyl methacrylate and/or vinyl sulfonic acid. The "glycidyl acrylate" refers to alkyl acrylate monomers integrated with glycidyl functional groups. In accordance with certain aspects, the alkyl group may have a chain length of $C_1$ to $C_{12}$ carbon atoms and it can be manipulated according to the artisan's requirement to achieve the desired composition. Exemplary alkyl acrylates monomers employed include, but are not limited to, glycidyl methacrylate, glycidyl ethacrylate, glycidyl butylacrylate and/or glycidyl dodecylacrylate.

The epoxy compounds may be selected from the group of aromatic epoxides, alicyclic epoxides, and the like. The alicyclic epoxide compound comprises a cylcohexeneoxide or cyclopenteneoxide obtained by epoxidizing a compound having at least one cycloalkane ring such as cyclohexene or cyclopentene with an oxidizing agent such as hydrogen peroxide or a peracid. The aromatic epoxides may be di- or poly-glycidyl ethers prepared by reacting a polyvalent phenol having at least one aromatic ring or the alkyleneoxide adduct thereof with epichlorohydrin, for example, di- or poly-glycidyl ethers of bisphenol A.

Monofunctional and polyfunctional epoxy compounds may be employed for cross-linking in accordance with certain aspects of the present application as detailed below.

Non-limiting examples of monofunctional epoxy compounds include, but are not limited to, phenyl glycidylether, p-tert-butylphenyl glycidylether, butyl glycidylether, 2-ethylhexyl glycidylether, allyl glycidylether, 1,2-butyleneoxide, 1,3-butadienemonooxide, 1,2-epoxydodecane, epichlorohydrin, 1,2-epoxydecane, styreneoxide, cyclohexeneoxide, 3-methacryloyloxymethylcylcohexeneoxide, 3-acryloyloxymethylcylcohexeneoxide, 3-vinylcylcohexeneoxide, and the like. The non-limiting examples of multifunctional epoxy compounds include bisphenol A diglycidylether, bisphenol F diglycidylether, bisphenol S diglycidylether, brominated bisphenol A diglycidylether, brominated bisphenol F diglycidylethers, brominated bisphenol S diglycidylether, epoxy novolak resins, hydrogenated bisphenol A diglycidylethers, hydrogenated bisphenol F diglycidylethers, hydrogenated bisphenol S diglycidylethers, 3,4-epoxycyclohexylmethyl-3',4'-epoxycyclohexanecarboxylate, 2-(3,4-epoxycyclohexyl-5,5-spiro-3,4-epoxy) cyclohexane-meta-dioxane, bis(3,4-epoxycyclohexylmethyl) adipate, vinylcylcohexeneoxide, 4-vinylepoxycyclohexane, bis(3,4-epoxy-6-methylcyclohexylmethyl) adipate, 3,4-epoxy-6-methylcyclohexyl-3',4'-epoxy-6'-methylcyclohexane carboxylate, methylene-bis(3,4-epoxycyclohexane), dicyclopentadiene diepoxide, ethylene glycol di(3,4-epoxycyclohexylmethyl)ether, ethylene bis(3,4-epoxycyclohexanecarboxylate), epoxyhexahydrodioctyl phthalate, epoxyhexahydrodi-2-ethylhexyl phthalate, 1,4-butanediol diglycidylether, 1,6-hexanediol diglycidylether, glycerol triglycidylether, trimethylolpropane triglycidylether, polyethylene glycol diglycidylether, polypropylene glycol diglycidylether, 1,1,3-tetradecadienedioxide, limonenedioxide, 1,2,7,8-diepoxyoctane, 1,2,5,6-diepoxycyclooctane, and the like.

According to one embodiment of the present application, the coating composition comprising a dye scavenging agent, a film forming agent, a rheology modifying agent and a cross-linking agent is polymerized or cured with or without a catalyst to yield a desired coating onto an imprinted image. The curing or polymerizing of the composition may be carried out by any appropriate method known or explored in the art by a person skilled in the art. Particularly, the polymerization may be carried out by any one of the methods disclosed in "*Principles of Polymerization*" 4$^{th}$ *edition,* 2004, Wiley by George Odian, the contents of which are hereby incorporated by reference. The polymerization or curing of the coating composition of the present application may be performed in the presence of a suitable catalyst or initiators such as amines, bases, organic acids and/or photo-initiators.

The term "initiator" is used herein in a broad sense, in that it is a composition which under appropriate conditions will result in the polymerization of a monomer. Materials for initiation may be photoinitiators, chemical initiators, thermal initiators, photosensitizers, co-catalysts, chain transfer agents, and radical transfer agents. All initiators known in the art are potentially suitable for the practice of the priming technique. The critical property of an initiator is that polymerization will not proceed at a useful rate without the presence of the initiator.

Photoinitiators employed in the present application for polymerization or curation of applied coating include UV-radiation, UV-LED, laser beam, electron beam, gamma irradiation, free-radical, cationic, anionic, thermal, exposure to e-beam and/or by employing a high-energy source for the initiation of polymerization. Suitable sources of radiation include, but not limited to, mercury, xenon, halogen, carbon arc lamps, sunlight, and radioactive sources.

In order to induce polymerization via irradiation, often an appropriate photoinitiator(s), which has high storage stability after being added, are incorporated to initiate the polymerization reaction system. Particularly useful photoinitiators may be selected from the following non-limiting group or class of compounds such as 2-hydroxy-2-methyl-1-phenylpropane-1-one, 1-hydroxycyclohexyl phenyl ketone, and 2-methyl-1-[4-(methylthio)phenyl]-2-morphorinopropane-1-on; benzoins e.g. benzyl dimethyl ketal; benzophenones such as benzophenone, 4-phenylbenzophenone, and hydroxybenzophenone; thioxanthones such as isopropylthioxanthone and 2,4-diethylthioxanthone; acylphosphine oxides; and other special initiators such as methyl phenyl glyoxylate; bis[4-(di(4-(2-hydroxyethyl)phenyl)sulfonio)phenyl sulfide], a mixture of bis[4-diphenylsulfonio]phenyl)sulfide bis (hexafluoroantimonate and diphenyl-4-thiophenoxyphenylsulfonium hexafluoroantimonate, bis[4-(di(4-(2-hydroxyethyl)phenyl)sulfonio)phenyl sulfide], 5-2,4-cyclopentadiene-1-yl-[(1,2,3,4,5,6-.eta.)-(1-methyl ethyl-) benzene]-iron (1+)-hexafluorophosphate(1−)), 4-(2-hydroxytetradecanyloxy) diphenyliodonium hexafluoroantimonate, (4-hydroxynaphtyl) dimethylsulfonium hexafluoroantimonate), triphenylsulfonium hexafluorophosphate, triphenylsulfonium hexafluoroantimonate, 4-methoxyphenyldiphenylsulfonium hexafluoroantimonate, 4-methoxyphenyliodonium hexafluoroantimonate, bis(4-tert-butylphenyl)iodonium tetrafluoroborate, (bis(4-tert-butylphenyl)iodonium hexafluorophosphate), (bis(4-tert-phenyl)iodonium hexafluoroantimonate), (bis[4-(diphenylsulfonio)phenyl]sulfide bis (hexafluorophosphate)), Aryldiazonium salts, diaryliodonium salts, triaylsulfonium salts, triarylselenonium salts, dialkylphenacylsulfonium salts, triarylsulfoxonium salts, aryloxydiarylsulfonium salts, and the like for example, triphenylsulfonium hexafluorophosphate, methyldiphenylsulfonium hexafluorophosphate, dimethylphenylsulfonium hexafluorophosphate, diphenylnapththylsulfonium hexafluorophosphate, di(methoxynapththyl) methylsulfonium hexafluorophosphate, (4-octyloxyphenyl) phenyl iodonium hexafluoro antimonate, (4-octyloxyphenyl) diphenyl sulfonium hexafluoro antimonate, (4-decyloxyphenyl) phenyl iodonium hexafluoro antimonite, (4-dodecyloxyphenyl)diphenyl sulfonium hexafluoroantimonate. Particularly, employed photoinitaitors include 10-biphenyl-4-yl-2-isopropyl-9H-thixanthen-10-ium hexafurophosphate, 4,4'-dimethyl iodonium hexafluorophosphate, mixed triarylsulfonium hexafluorophosphate salts and reaction products of polyol and 10-(2-carboxymethoxy)-biphenyl-4-yl-2-isopropyl-9-oxo-9H-thioxanthen-10-ium hexaflruophosphate. Further, these photoinitiators may be used alone or in combination thereof. Alternatively, if essential, the photoinitiator may be used along with one or more suitable donor compounds or suitable photopolymerization accelerators, for example, amines, oraganic acids, peroxides, phosphorus compounds, ketones and alpha-diketone compounds.

Examples of tertiary amine photopolymerization accelerators that may be used include triethanolamine, methyldiethanolamine, triisopropanolamine, 4,4'-dimethylaminobenzophenone, 4,4'-diethylaminobenzophenone, ethyl 2-dimethylaminobenzoate, ethyl 4-dimethylaminobenzoate, (n-butoxy)ethyl 4-dimethylaminobenzoate, isoamyl 4-dimethylaminobenzoate, and 2-ethylhexyl 4-dimethylaminobenzoate. Particularly preferred are ethyl 4-dimethylaminobenzoate, (n-butoxy)ethyl 4-dimethylaminobenzoate, isoamyl 4-dimethylaminobenzoate, and 2-ethylhexyl 4-dimethylaminobenzoate.

Particularly useful photo-initiation accelerators include benzoic acids (for example, 4-dimethylaminobenzoic acid, benzoylbenzoic acid), tertiary amines (triethyl amine) or sodium hydroxide (NaOH) in any appropriate ratio. The photoinitiator may be added to the photopolymerizable coating composition in the range of about 0.1% to about 20% by weight.

According to one embodiment of the present application, the polymerization of applied coating is conducted through free-radical polymerization in the presence of a free-radical initiator. A free radical initiator refers to any chemical moiety which, upon exposure to an appropriate energy source (e.g., light or heat) decomposes in to two independent uncharged fragments left with highly reactive one unpaired electron. The contemplated free radical initiator for polymerization includes, but is not limited to, various derivatives of peroxides, peresters and/or azo compounds. More particularly, the initiator may be selected from the group consisting of dicumyl peroxide, dibenzoyl peroxide, 2-butanone peroxide, tert-butyl perbenzoate, di-tert-butyl peroxide, 2,5-bis(tert-butylperoxy)-2,5-dimethylhexane, bis(tert-butyl peroxyisopropyl)benzene, and tert-butyl hydroperoxide), diacyl peroxides, cumene hydroperoxide, dialkyl peroxides, hydroperoxides, ketone peroxides, monoperoxycarbonates, peroxydicarbonates, peroxyesters, and peroxyketals, including tertiary butyl perbenzoate, tertiary butyl peroctoate in diallyl phthalate, diacetyl peroxide in dimethyl phthalate, dibenzoyl peroxide, 1-hydroxy cyclohexyl-1-phenyl ketone, bis(2,4,6-trimethyl benzoyl)phenyl phosphine, benzoin ethyl ether, 2,2-dimethoxy-2-phenyl acetophenone, di(p-chlorobenzoyl) peroxide in dibutyl phthalate, di(2,4-dichlorobenzoyl) peroxide with dibutyl phthalate, dilauroyl peroxide, methyl ethyl ketone peroxide, cyclohexanone peroxide in dibutyl phthalate, 3,5-dihydroxy-3,4-dimethyl-1,2-dioxacyclopentane, t-butylperoxy(2-ethyl hexanoate), caprylyl peroxide, 2,5-dimethyl-2,5-di(benzoyl peroxy) hexane, 1-hydroxy cyclohexyl hydroperoxide-1, t-butyl peroxy (2-ethyl butyrate), 2,5-dimethyl-2,5-bis(t-butyl peroxy) hexane, cumyl hydroperoxide, diacetyl peroxide, t-butyl hydroperoxide, ditertiary butyl peroxide, 3,5-dihydroxy-3,5-dimethyl-1,2-oxacyclopentane, and 1,1-bis(t-butyl peroxy)-3,3,5-trimethyl cyclohexane and di-(4-t-butyl cyclohexyl) peroxydicarbonate, azo compounds such as azobisisobutyronitrile and azobiscyclohexanenitrile (e.g., 2,2'-azobis(2-methyl-propanenitrile), 2,2'-azobis(2-methylbutanenitrile), and 1,1'-azobis(cyclohexanecarbonitrile)) and the like mixtures and combinations thereof. Alternatively, all of the above revealed free radical initiator may be used for thermal based polymerization alone or appropriate mixture thereof and wherein the polymerization reaction is initiated through heat energy. Particular examples of thermal initiators employed for the polymerization of polymer include 2,2'-azobis(2,4-dimethylpentanenitrile), 2,2'-azobis(2-methylpropanenitrile), 2,2'-azobis(2-methylbutanenitrile), peroxides such as benzoyl peroxide, and the like. Preferably, the thermal initiator is 2,2'-azobis(isobutyronitrile).

Rheology modifying agents may also be incorporated in the composition as an optional component. The preferred rheology modifying agents include carboxyvinyl polymers, copolymer or terpolymers of carboxyvinyl polymer, cationic copolymers, polyquaternium compounds, carrageenan, hydroxyethyl cellulose, laponite and water soluble salts of cellulose ethers such as sodium carboxymethylcellulose and sodium carboxymethyl hydroxyethyl cellulose. Natural gums such as gum karaya, xanthan gum, gum arabic, and gum tragacanth may be used.

In accordance with certain aspects, the rheology modifying agent of the present application may be obtained by polymerizing one or more monomers selected from (A) N-vinyl lactams, N-vinyl imidazoles, and (B) at least one monomer selected from $\alpha,\beta$-ethylenically unsaturated monomers having at least one cationic group, quaternized amino alkyl acrylamides or their salts, and blends thereof.

The N-vinyl lactam derivatives may, for example, have one or more $C_1$-$C_6$ alkyl substituents, such as methyl, ethyl, n-propyl, isopropyl, n-butyl, sec-butyl, tert-butyl, etc. These include, for example, N-vinyl-2-pyrrolidone, N-vinyl-2-piperidone, N-vinyl-2-caprolactam, N-vinyl-5-methyl-2-pyrrolidone, N-vinyl-5-ethyl-2-pyrrolidone, N-vinyl-6-methyl-2-piperidone, N-vinyl-6-ethyl-2-piperidone, N-vinyl-7-methyl-2-caprolactam, N-vinyl-7-ethyl-2-caprolactam, N-vinyl-2-valerolactam, 4-methyl-N-vinyl-2-pyrrolidone, 3,5-dimethyl-N-vinyl-2-caprolactam, N-vinyl-hexahydro-2-azepinone, N-vinyl-octahydro-2-azocinone, N-vinyl octahydro-2-azoninone and N-vinyl decahydro-2-azecinone, etc. Preference is given to using N-vinyl-2-pyrrolidone and/or N-vinyl-2-caprolactam.

Comonomers useful for preparing the rheology modifying crosslinked polymer (B) include N-tert-butylaminoethyl (meth)acrylate, N,N-dimethylaminomethyl(meth)acrylate, N,N-dimethylaminoethyl(meth)acrylate, N,N-diethylaminoethyl(meth)acrylate, N,N-dimethylaminopropyl(meth)acrylate, N,N-diethylaminopropyl(meth)acrylate and N,N-dimethylaminocyclohexyl(meth)acrylate, dimethylaminomethyl acrylate, diethylaminomethyl acrylate, dimethylaminoethyl acrylate, dimethylaminobutyl acrylate, dimethylaminobutyl methacrylate, dimethylaminoamyl methacrylate, diethylaminoamyl methacrylate, dimethylaminohexyl acrylate, diethylaminohexyl methacrylate, dimethylaminooctyl acrylate, dimethylaminooctyl methacrylate, diethylaminooctyl acrylate, diethylaminooctyl methacrylate, dimethylaminodecyl methacrylate, dimethylaminododecyl methacrylate, diethylaminolauryl acrylate. diethylaminolauryl methacrylate, dimethylaminostearyl acrylate, dimethylaminostearyl methacrylate, diethylaminostearyl acrylate and diethylaminostearyl methacrylate. Particularly useful are N-tert-butylaminoethyl(meth)acrylate and N,N-dimethylaminoethyl (meth)acrylate. Particular preference is furthermore given to N,N-dimethylaminoethyl acrylate and N,N-dimethylaminoethyl methacrylate.

The suitable amide based comonomers (B) for preparing a rheology modifying agent of present application may be selected from a group of compounds including, but not limited to, α,β-ethylenically unsaturated mono and dicarboxylic acids with diamines having at least one primary or secondary amino group in it. Diamines which have one tertiary and one primary or secondary amino group are particularly useful. The most appropriate monomers include, but are not limited to, N-tert-butylaminoethyl(meth)acrylamide, N-[2-(dimethylamino)ethyl]acrylamide, N-[2-(dimethylamino)ethyl] methacrylamide, N-[3-(dimethylamino)propyl]acrylamide, N-[3-(dimethylamino)propyl]methacrylamide, N-[4-(dimethylamino)butyl]acrylamide, N-[4-(dimethylamino)butyl] methacrylamide, N-[2-(diethylamino)ethyl]acrylamide, N-[4-(dimethylamino)cyclohexyl]acrylamide and N-[4-(dimethylamino)cyclohexyl]methacrylamide, N-[12-(dimethylamino) dodecyl]methacrylamide, N-[18-(dimethylamino) octadecyl]methacrylamide, N-[8-(dimethylamino) octyl]methacrylamide, N-[7-(dimethylamino) heptyl]acrylamide, N-[14-(dimethylamino) tetradecyl]acrylamide, N-[3-(dimethylamino) propyl]methacrylamide, N-[3-(diethylamino) propyl]acrylamide, N-(4-(dipropylamino) butyl] methacrylamide, N-[3-(methyl butylamino) propyl] acrylamide, N-(2-[3-(dimethylamino) propyl]ethyl) acrylamide, N-(4-[4-(diethylamino) butyl]butyl)acrylamide. Special significance is given to N-[3-(dimethylamino)propyl] acrylamide, N-[3-(dimethylamino)propyl]methacrylamide (DMAPMA) and mixtures thereof.

Particularly useful rheology modifying agents include, but are not limiting to, crosslinked polyvinyl pyrrolidone, polyvinylpolypyrrolidone, vinylcaprolactam/dimethylaminopropyl methacrylamide/hydroxymethyl methacrylate terpolymer, dimethylaminopropyl methacrylamide-hydroxymethyl methacrylate copolymer, vinylpyrrolidone/dimethylaminopropyl methacrylamide copolymer, and/or quaternized vinylpyrrolidone/dimethylaminoethylmethacrylate copolymer, polyvinyl pyrrolidone/vinyl acetate copolymer, polyvinyl pyrrolidone/styrene copolymer.

Non-limiting examples of rheology modifying polymers of the present application include Carbomer® 940 (Carbomer), UltraThix™ P-100 (acrylic acid/VP Crosspolymer), Stabileze® QM (PVM/MA decadiene crosspolymer), RapiThix ° A-60 (sodium polyacrylate (and) hydrogenated polydecene (and) Trideceth-6) and/or Aculyn 28 (acrylates/beheneth-25 methacrylate copolymer), ViviPrint™, ViviPrint™, ViviPrint™ 121, ViviPrint™ 131, ViviPrint™ 200, ViviPrint™ 300, ViviPrint™ 540, ViviPrint™ PS-10, Gafquat®, Gafquat®734, Gafquat®755, Gafquat®755N, Gafquat® HS-100, (Styleze® CC-10), PQ-11(Gafquat® 755N), PQ-55 (Styleze® W20), PQ-28 (Conditioneze® NT-20) or FlexiThix™ (VP crosspolymer).

In accordance with one aspect, the dye scavenging article of the present application is meant to be used as part of a regular laundering routine. The article is put in to a home or commercial washing machine along with required amount of detergent, clothes and other fabric items to be washed, and any other additives of interest, such as fabric softeners, which may be added. During the course of wash cycle, the dye scavenging article will absorb or inhibit of fugitive dyes released from the clothes. The dye scavenging article may be fixed in one place or may be allowed to move freely around the wash solution, coming into contact with fugitive dyes, absorbing them, and retaining them on the imprinted image of the article permanently to create a colored impression of a picture or desired information if any. The article may also capture any dyes released during the rinse cycle. Upon completion of the entire wash period, the article may be removed and disposed of.

In a particularly useful aspect of the present application, a method of manufacturing a dye-scavenging article comprises the steps of (a) providing a support substrate comprising a desired imprint of an image on at least one surface or side of the substrate; (b) applying coating of an aqueous coating composition comprising (i) a dye scavenging agent; (ii) optionally, a film forming agent, optionally, a cross-linking agent, optionally, a rheology modifying agent and/or optionally, a catalyst; and (c) polymerizing the coating resulting from (b) by an appropriate method which is known to a person skilled in the art, preferably through thermal method and/or irradiation method.

A method of absorbing and/or inhibiting transfer of fugitive dyes released during laundering comprises introducing a dye scavenging article to a wash liquor of a laundering machine, wherein the article comprises: (i) a support substrate comprising a desired imprint of an image on at least one surface of the substrate; (ii) at least one dye scavenging agent fixably adhered onto the imprinted image; (iii) optionally, at least one film-forming agent fixably adhered to the imprinted image; (iv) optionally, at least one polymerizable cross-linking agent fixably adhered to the imprinted image; (v) optionally, at least one rheology modifying agent fixably adhered to the imprinted image; and (vi) optionally, at least one catalyst.

Further, certain aspects of the present invention are illustrated in detail by way of the following examples. The examples are given herein for illustration of certain aspects of the invention and are not intended to be limiting thereof.

Example 1

| Product | Mass | Solids % | Solid Mass (g) | Dry Composition (%) |
|---|---|---|---|---|
| Water | 389 | | | |
| Polyvinyl pyrrolidone | 71 | 100 | 71 | 23.9 |
| Poly(Vinylpolypyrrolidone) | 130 | 11 | 14.3 | 4.82 |
| Modified Styrene-Butadiene latex | 440 | 48 | 211.2 | |
| Total | 1030 | | 296.5 | 71.2 |

Example 2

| Product | | Mass (g) |
|---|---|---|
| Poly(vinyl polypyrrolidone) | | 71 |
| Modified Styrene-Butadiene latex | | 440 |
| Water | | 120 |
| Total | | 631 |
| Brookfield Viscosity | 176,000 | LV, #64, RPM 3, 85% Scale |
| Percent Solids | ~44 | |
| Brookfield Viscosity | 2,100 | LV, #64, RPM 50, 18% Scale |
| Percent Solids | ~38 | |

Example 3

| Product | Percent Solids | Mass (g) |
|---|---|---|
| Poly(vinyl polypyrrolidone) | 100 | 7.1 |
| Vinyl acetate ethylene copolymer | 55 | 38.4 |
| Water | | 28.8 |
| Total | | 74.3 |
| Brookfield Viscosity (LV, #2, 10 RPM) | | 750 cPs |

Example 4

| Product | Percent Solids | Mass (g) |
|---|---|---|
| Vinylpyrrolidone/Vinylacetate/Glycidylmethacrylate | 100 | 5.8 |
| 3,4-Epoxy cyclohexyl methyl-3,4-Epoxycyclohexane carboxylate | 100 | 52 |
| VP/Dimethylaminoethyl methacrylate copolymer (in ethanol) | 100 | 12 |
| Ethanol | 100 | 30.2 |

Cured film at 140° C. for ~30 minutes

While this invention has been described in detail with reference to certain preferred embodiments, it should be appreciated that the present invention is not limited to those precise embodiments. Rather, in view of the present disclosure, many modifications and variations would present themselves to those skilled in the art without departing from the scope and spirit of this invention.

What is claimed is:

1. A visually perceivable image-forming dye scavenging article capable of absorbing and/or inhibiting transfer of fugitive dyes released during laundering, the article comprising:

i. a support substrate comprising a desired imprint of an image on at least one surface of said substrate;

ii. a terpolymer of vinylpyrrolidone/vinylacetate/glycidylmethacrylate fixably adhered on to the imprinted image;

iii. a 3,4-epoxy-cyclohexyl-methyl-3,4-epoxycyclohexane-carboxylate fixably adhered to the imprinted image; and iv. a quaternized vinylpyrolidone/dimethylaminoethyl methacrylate copolymer fixably adhered to the imprinted image.

2. The dye scavenging article according claim 1, wherein the support substrate is natural fabric, synthetic fabric, natural non-woven fabric and/or synthetic non-woven fabric.

3. The dye scavenging article according to claim 2, wherein said fabric is spunlaced, spunbonded, thermobonded and/or airlaided.

4. The dye scavenging article according to claim 1, wherein the support substrate comprises cellulosic fibers, polyolefins, polyesters, starches, modified starches, and combinations thereof.

5. The dye scavenging article according to claim 1, wherein the support substrate is continuous ring or rectangular fabric sheet.

6. The dye scavenging article according to claim 1, wherein the imprinted image is selected from the group consisting of pictures, shapes, symbols, trademark, alphabets of any language numerical letters of any language, and combinations thereof.

7. The dye scavenging article according to claim 1, wherein the imprinted image is means for communicating a message or carrier for information to its users.

8. The dye scavenging article according claim 1, wherein said quaternized vinylpyrolidone/dimethylaminoethyl methacrylate copolymer has an average molecular weight of from about 500 to about 200,000.

9. The dye scavenging article according claim 1, further including a film forming agent wherein the molecular weight of said film forming agent is in the range of about 5,000 to about 5,000,000.

* * * * *